United States Patent [19]

Krob et al.

[11] 4,384,733

[45] May 24, 1983

[54] SOLE OR HEEL HOLDER

[75] Inventors: Erwin Krob, Vienna; Wilhelm Rohner, Fischamend, both of Austria

[73] Assignee: TMC Corporation, Baar, Switzerland

[21] Appl. No.: 211,869

[22] Filed: Dec. 1, 1980

[30] Foreign Application Priority Data

Nov. 30, 1979 [AT] Austria ..... 7621/79

[51] Int. Cl.[3] ..... A63C 9/085

[52] U.S. Cl. ..... 280/632; 280/634

[58] Field of Search ..... 280/632, 631, 634, 628

[56] References Cited

U.S. PATENT DOCUMENTS

| | | | |
|---|---|---|---|
| 3,494,220 | 2/1970 | Smolka | 280/634 |
| 3,689,097 | 9/1972 | Smolka | 280/631 |
| 3,754,770 | 8/1973 | Suhner | 280/632 |
| 3,933,363 | 1/1976 | Schweizer et al. | 280/632 |
| 4,103,930 | 8/1978 | Valok | 280/631 |

FOREIGN PATENT DOCUMENTS

| | | | |
|---|---|---|---|
| 2456326 | 8/1976 | Fed. Rep. of Germany | 280/631 |

*Primary Examiner*—David M. Mitchell

*Attorney, Agent, or Firm*—Flynn, Thiel, Boutell & Tanis

[57] ABSTRACT

A sole or heel holder of a ski binding has a housing and sole down-holding member pivotally supported on a base and latched in a closed position for skiing by a U-shaped locking pawl which is pivotally supported on the housing, has a roller at the end of each leg, and has a row of notches along the bight. The bight is substantially vertical, one roller is disposed against the down-holding member, and the other roller is disposed against a detent on the base. A support part is pivotally supported on the base and positionally adjustable relative to the housing by means of a setscrew, and a spring-loaded locking element is slidably supported thereon and selectively engages the different notches in the pawl in response to rotation of the setscrew. A release lever is pivotally mounted to the base and cooperates with the pawl through a linking member for effecting a voluntary release of the latched housing and down-holding member.

11 Claims, 5 Drawing Figures

SOLE OR HEEL HOLDER

FIELD OF THE INVENTION

This invention relates to a sole or heel holder for a ski and, more particularly, to such a holder having a sole down-holding means which is pivotal with respect to a ski-fixed base part or bearing block and which is held in the downhill skiing position by a locking pawl which has a notch engaged by a spring-loaded locking part.

BACKGROUND OF THE INVENTION

In a sole or heel holder of the foregoing type, the locking part usually is at least a part of a spring abutment which is supported for limited movement in a guideway of a support part, which support part is pivotally supported about an axis on the base part or bearing block, and one side of the locking pawl usually is associated with a detent and the other side has the notch.

Such a sole or heel holder, in which the release lever is hinged to the support part, is already known from Applicants' Austrian Pat. No. 275 372 and has proven successful in practice. There, the locking spring always acts on the sole holder. Upon operation of the release lever, the locking pawl is totally released, but the release lever remains under the influence of the spring and in this manner the sole holder does too. The notch is therefore constructed as an actual recess.

From a further development of this sole or heel holder, in which upon operation of the release lever both the lock and also the sole down-holding means leave totally the range of action of the locking spring, a solution is also known in which the detent is arranged on the base part, the locking pawl grips under the same and is hinged on the sole down-holding means, and the release lever is also hinged to the locking pawl, on which is provided following the detent a recess, into which recess the locking part moves upon operation of the release lever and which recess is closer to the swivel axis of the locking pawl than to the detent. Also, the support part carries the second spring abutment.

In a different known sole or heel holder, one side of a locking pawl grips over a locking bolt of the pivotal sole down-holding means and the pawl has on the other side a cam plate. A spring-loaded locking part engages the cam plate, which locking part is arranged together with the loading spring on a swingable release lever. If the release lever is pressed downwardly, the locking part moves along the cam plate to an end position. Through this, the length of the effective lever arm through which the locking part acts onto the locking pawl is reduced, and the locking pawl when swivelling must overcome only the effective spring force. Here too, however, both the locking pawl and the sole down-holding means are always under the influence of the spring.

Furthermore, a ski binding is known in which a swingable locking pawl cooperates on one side with a swingable sole down-holding means and on the other side has a cam plate, along which cam plate a spring-loaded locking part can be moved by means of a release lever. The cam plate extends to the swivel axis of the locking pawl so that, upon a movement of the locking part to this region, the line of action of the loading spring goes through the swivel axis of the locking pawl. Through this, the effective force of the spring onto the locking pawl is substantially overcome, and the locking pawl can be swivelled with a relatively low force input.

A spring force, however, albeit a very small force, continues to act both onto the locking pawl and also onto the sole down-holding means. Furthermore, the release lever must constantly be pressed if the foregoing conditions are supposed to be maintained. If the release lever is no longer loaded, then the locking member moves automatically into the locking position and a swivelling of the sole down-holding means requires that the entire spring force must be overcome through the locking pawl.

In all these known solutions, it is disadvantageous that the release or the swivelling of the sole or heel holder can take place only with considerable friction forces which are created between the locking pawl and the detent on the one hand and between the locking pawl and the locking part on the other hand.

SUMMARY OF THE INVENTION

The purpose of the invention is to overcome these disadvantages and to design a ski binding of the above-mentioned type in which a release or a swivelling of the sole or heel holder can be carried out without creating high friction forces.

This purpose is attained inventively by the locking pawl, viewed in a longitudinal cross-section, being designed as an approximately U-shaped member with different length legs, the lower leg extending into a recess of the bearing block and being supported on a shoulder of the sole down-holding means, and the upper leg being pivotal in the region of a detent on which detent at least the end region of the upper leg of the locking pawl rests. A row of notches is provided on the bight of the U-shaped locking pawl, which bight extends substantially in a vertical direction and on which notches the spring-loaded locking part can be selectively supported. The locking part is constructed to be adjustable vertically by means of an upwardly projecting setscrew for effecting the selective support of the locking part on one of the notches.

Through this inventive measure the necessary spring force can be adjusted on the one hand and, on the other hand, it is assured that undesired friction forces are not created between the locking pawl and the detent, because a small gap can be provided between the upper side of the upper leg of the locking pawl and the lower side of the detent in the downhill skiing position, care being taken to assure that prior to the release a defined positioning exists between these two elements.

A particularly advantageous embodiment of the invention consists in the support part for the locking part being constructed as a forked member with two sidewalls, wherein between the two sidewalls there is provided at least one spring and preferably two springs, which spring is supported on a pair of spring abutments, each spring abutment adjacent the locking pawl having a locking part thereon which can be supported selectively on a notch of the bight of the locking pawl, and each spring abutment not adjacent the locking pawl being connected fixedly with at least one of the sidewalls of the support part or being constructed out of same. This permits a large selection for the designer in the specification of the spring characteristic.

A further characteristic of the invention consists in the setscrew, by means of which the vertical position of the support part can be adjusted, having threads which cooperate with a counterthread of an operating shoulder provided either on the support part or on the sidewalls thereof, in the latter case preferably between the two sidewalls. This design is space-saving in a vertical direction of the sole or heel holder, whereby viewed laterally sufficient space is provided for the arrangement of such a structural part.

A still further development of the invention consists in the axle of the locking pawl, about which axle the pawl is pivotal, being guided in an arcuate slot which is constructed to extend concentrically with respect to the axis of the sole down-holding means. Through this, undesired friction forces are avoided during swivelling of the locking pawl.

A still further development of the invention consists in the locking pawl being hinged to a release lever by means of a link member, which release lever is pivotally supported on the bearing block and is guided by means of a pin in a slotted hole in the link member. This measure assures that upon an automatic release, for example during a fall of the skier, the release lever remains in its position and no additional friction forces must be overcome, so that the entire release operation can be calculated more exactly.

Furthermore, it is provided according to the invention that, as is actually known, the sole down-holding means is loaded through the housing by a spring, which spring preferably is designed as a torsion spring provided around the pivot axis of the housing and supported with one leg on the base plate and with its other leg on the housing. In this manner, it is assured that, after an opening of the sole or heel holder, same is always held ready for stepping in.

BRIEF DESCRIPTION OF THE DRAWINGS

Further advantages, details and characteristics of the invention will now be described in greater detail with reference to the drawings, in which.

DETAILED DESCRIPTION

Figure 1:
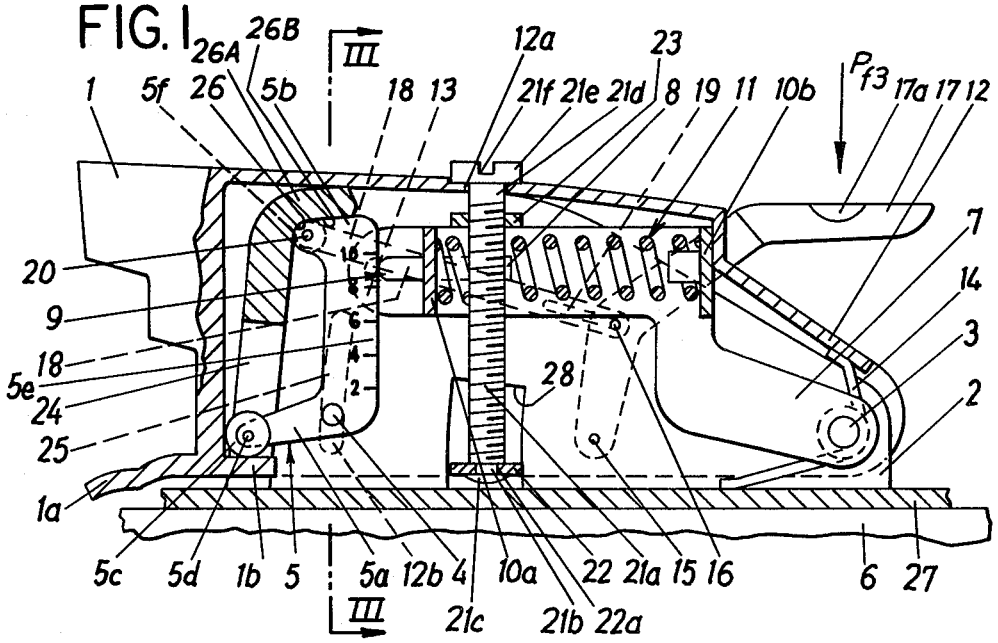
FIG. 1 is a partial cross-sectional view of an inventive sole or heel holder of a safety ski binding in a closed position.

As one can see from FIG. 1, the inventive sole or heel holder includes a base part or a bearing block 2 having a base plate 27 secured to the upper surface of a ski 6 by means which are conventional and therefore not illustrated in detail. A housing 12 is pivotally supported on the bearing block 2 by means of an axle 3 which extends transversely with respect to the longitudinal axis of the ski 6. A sole down-holding member 1 is provided on the housing 12 on its end region remote from the axle 3. The down-holding member 1 includes a spur 1*a* and a shoulder 1*b* which serves as a support. The position of the sole down-holding member 1, as is actually known and therefore not shown in detail, is adjustable relative to the housing 12 in the vertical direction, in order to be able to accommodate ski boot soles of differing thickness. Furthermore, a support part 7 (FIGS. 1 and 4) is hingedly connected to the axle 3 and has longitudinal slots 8 (FIG. 1) in its sidewalls 7*a*,7*b* forming a guideway for a locking part 9. The locking part 9 is biased by a spring package 11, to be described in detail below, which spring package 11 is held in the support part 7 between two spring abutments 10*a*,10*b* which extend between the sidewalls 7*a*,7*b* and are respectively movably supported on and secured to the sidewalls 7*a*,% 7*b*. The spring abutment 10*a* carries on its side which is remote from the spring package 11 a locking part 9 (see FIG. 4).

A locking pawl 5 is pivotally supported on the housing 12 in the region of the support part 7 adjacent the locking part 9 about a further axle 4 which also extends transversely with respect to the longitudinal axis of the ski 6. An arcuate slot 25 is provided in the bearing block 2 to receive the swivel axle 4. The center point of the radius for the arcuate slot 25 is coincident with the axis of the axle 3 on the support part 7 and the housing 12. The length of the slot 25 determines the pivoting range of the sole or heel holder. Furthermore, an arcuate slot 12*b* (FIGS. 1 and 3) is provided in the housing 12, the centerline of which slot extends as a continuation of the centerline of the slot 25. The length of the slot 12*b* determines the first phase of the elasticity range of the sole or heel holder.

Figure 2:
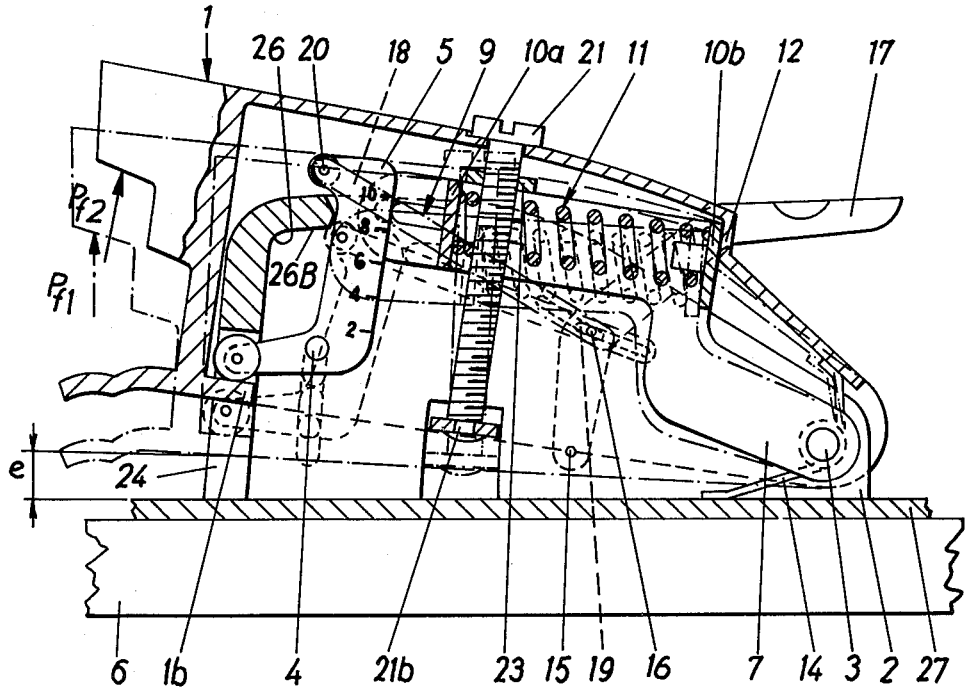
FIG. 2 illustrates the sole or heel holder of FIG. 1 in two positions, the dash-dotted line position being the elasticity range and the solid line position being the released position.
Figure 1A:
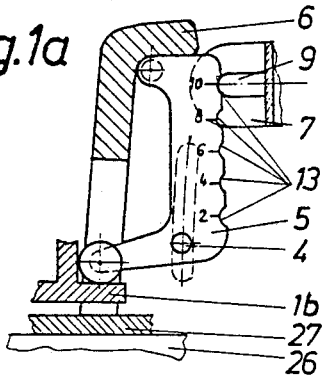
FIG. 1*a* is a modification of the locking pawl of FIG. 1.

The locking pawl 5 pivotally supported on the axle 4 has, viewed in a cross-section thereof (FIGS. 1 and 2), approximately a U-shaped design with different length legs 5*a*,5*b*. The lower leg 5*a* extends, in the closed position of the sole or heel holder according to FIG. 1, at an acute angle of 10° to 30° to the horizontal, preferably at an angle of approximately 20°, in a downward direction toward the shoulder 1*b* of the sole down-holding member 1 which serves as a support. The leg 5*a* has at its free end a roller 5*c* rotatably secured thereto by means of a pin 5*d*. A roller 5*f* is rotatably secured to the upper, shorter leg 5*b* of the locking pawl 5 by means of a pin 20. The roller 5*f* on the locking pawl 5 is supported on a detent 26 on the bearing block 2, which detent serves as a support. The detent includes an extension 26A having a downwardly facing surface 26B. The substantially vertically upwardly projecting web or bight portion 5*e* of the locking pawl 5 for purposes of a stepless adjusting, a flat surface (FIG. 1) or, for purposes of a stepped adjusting, a series of notches 13 therein (FIG. 1*a*) each of which is associated with a numerical value on the bight 5*e* which will yet be described in greater detail. One end of a platelike link member 18 is pivotally connected to the pin 20, and the other end is hingedly connected by means of a further pin 16 to a release lever 17. The release lever 17 is pivotally supported by means of an axle 15 on the bearing block 2. The release lever 17 has a recess 17*a* adapted to receive the tip of a ski pole therein. The end region of the lower leg 5*a* of the locking pawl 5 provided with the lower roller 5*c* is movable in the vertical direction in a recess 24 in the bearing block 2 adjacent and below the detent 26. The detent 26 includes, as stated above, an extension part 26A extending at a small inclined angle of approximately 5° to 10° with respect to the horizontal or the upper surface of the ski 6, the terminal end of which defines a release point for the upper leg 5*b* of the locking pawl 5, including the upper roller 5*f*. The link member 18 has a slotted hole 19 in one end thereof slidably receiving the pin 16 therein. The pin 16 is movably guided in the hole 19 in the direction of the longitudinal extend of the link member 18.

A setscrew 21, the axis of which is positioned perpendicularly to the upper surface of the ski 6, when the ski binding is in the closed position, is secured at its lower end in a mounting 22 on the housing 12. The mounting 22 can be swung upwardly about the axis of the axle 3 in a recess 28 in the bearing block 2. A smooth area 21*b* of reduced diameter on the shaft 21*a* of the setscrew 21 extends through an opening 22*a* in the mounting member 22, the free end of the setscrew 21 being closed off below the mounting member 22 by a rivetlike connection 21*c*. The further upwardly projecting portion of the shaft 21*a* of the setscrew 21 is provided with an external thread engaging a counterthread in an opening in an operating shoulder 23 secured to the support part 7. A thread-free neck 21*d* at the upper end of the setscrew 21*a* extends through an opening 12*a* in the housing 12; the setscrew 21 terminates above the housing 12 in an enlarged head 21*e* having a tool receiving slot 21*f* therein.

The housing 12 is biassed to the released position of the ski binding by a torsion spring 14 wound around the axle 3, one leg of which is supported on the ski-fixed base plate 27 and the other leg of which is supported on the inside of the housing 12.

Figure 4:
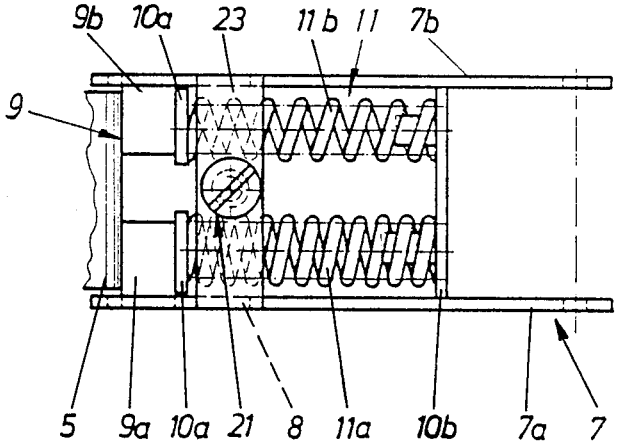
FIG. 4 is a top view of the locking part of the sole or heel holder of FIG. 1 with a portion of the structural parts not required for an understanding of the drawing omitted for better illustration purposes.

The spring package 11 consists, in the present exemplary embodiment, of two parallel side-by-side compression springs 11*a*,11*b*, which, as can be seen from FIG. 4, are arranged between the two sidewalls 7*a*,7*b* of the forked support part 7. Each of the two sidewalls 7*a*,7*b* of the support part 7 can, if desired, also be bent to a somewhat cylindrical shape to partially enclose the respective springs 11*a* and 11*b*, which sidewalls would still be fixedly connected to one another by means of the operating shoulder 23, through which extends the setscrew 21. Through this construction of the spring package 11 with the two springs 11*a* and 11*b*, the number of the aforedescribed longitudinal slots 8, locking parts 9 and the spring abutments 10*a*,10*b* and accordingly also the row of notches 13 on the web 5*e* of the locking pawl 5 is double the number required when only a single spring is utilized in the spring package 11. Regardless of the illustrated embodiment of the spring package 11, a construction is also conceivable in which a one-part support part 7 is provided and in which only one of each of the associated structural elements is required, as has been implied by the general description of the spring package 11 in preceding paragraphs.

If a vertical or diagnonal force which occurs on the ski boot of the skier acts onto the sole or heel holder, and is oriented in the direction of the dash-dotted arrow $P_{f1}$ (FIG. 2), then the sole down-holding member 1 first pivots together with the housing 12 about the axle 3 up to a limit, wherein the locking pawl 5 and the upper leg 5*b* and roller 5*f* pivot together but lie yet within the effective range of the detent 26 and extension 26A. This position is illustrated in dash-dotted lines in FIG. 2, wherein the degree of this range of swing is indicated as the elasticity range e of the sole or heel holder at the shoulder 1*b* of the sole down-holding member 2. If a further and greater force $P_{f2}$ acts onto the sole down-holding member 1, then the sole down-holding member 1 pivots with the housing 12 into the position which is shown in solid lines in FIG. 2, wherein the locking pawl 5 has gone beyond the extension 26A of the detent 26 and has penetrated the adjacent opening in the top of bearing block 2. The pivoting of the locking pawl 5 is accomplished against the force applied by the spring package 11 through the locking part 9, wherein during the swinging out, an increasingly greater spring force must be overcome due to this particular construction. To give the designer a larger choice in the selection of the spring characteristic, a spring package 11 having two pressure springs 11*a*,11*b* has been utilized. Since the locking pawl 5 follows the path of swing of the housing 12, its axle 4 is guided in the slot 25 of the bearing block 2, which slot 25, in order to avoid undesired friction forces, is constructed as an arcuate slot which extends concentrically with respect to the axle 3. In the case of such a release operation, the release lever 17 can, but does not necessarily, swivel about the axle 15 with the pin 16 supported in the slotted hole 19 in the link member 18.

During an arbitrary or voluntary stepping out of the ski binding, which process is not separately illustrated in the drawings, the skier presses the release lever 17 in the direction of the arrow $P_{f3}$ according to FIG. 1, either by means of a ski pole or by hand, whereby the release lever 17 is pivoted about the axle 15. The release lever 17 simultaneously acts through the link member 18 to pivot the locking pawl 5 against the force of the spring package 11 about its axle 4 until the upper roller 5*f* reaches the free end region of the extension 26A of the detent 26, after which the simultaneously upwardly pressed ski boot swings the sole down-holding member 1 together with the housing 12 upwardly to the position illustrated in solid lines in FIG. 2 so that the skier can step out of the binding. The front jaw of the binding may be constructed in a conventional manner.

Figure 3:
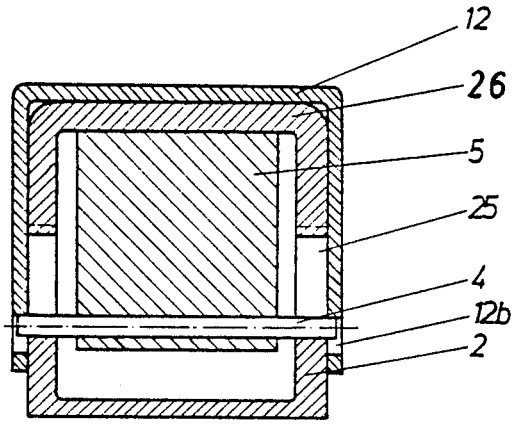
FIG. 3 is a cross-sectional view taken along the line III—III of FIG. 1.

FIG. 3 illustrates in a cross-sectional view the construction of the locking pawl 5 in connection with the front region of the bearing block 2, wherein some of the structural parts have been omitted for a better understanding. FIG. 4 illustrates in a top view the construction of the spring package 11 in connection with the support part 7, wherein some of the structural parts have also been omitted for a better understanding.

The torsion spring 14, in the open position of the sole or heel holder, constantly loads the housing 12 so that, after a fall or after an arbitrary or voluntary stepping out, the sole down-holding member 1 is maintained in the open position for stepping in purposes. This measure is known by itself and serves to facilitate an easier stepping in by the skier.

The notches 13 which are provided on the web 5*e* of the locking pawl 5 can be selectively engaged with the locking part 9 by rotating the setscrew 21. Since the spacing between the axle 3 of the support part 7 and the axle 4 of the locking pawl 5 is constant, the force with which the spring package 11 loads the locking pawl 5 becomes, in the position illustrated in FIG. 1, greater as the support part 7 and locking part 9 assume the positions which are respectively identified by the numerical reference values 10,8,6,4 or 2. At the same time, however, the length of the effective lever arm between the axle 4 and the locking part 9 is reduced at a relatively higher rate than the force of the spring package 11 increases, so that the torque which acts onto the locking pawl 5 and which is of decisive importance for effecting a proper release is reduced as a whole. In this manner, it is therefore possible for the binding installer to suitably adjust this torque to the characteristics of a skier by rotating the setscrew 21.

The invention is not limited to the illustrated exemplary embodiment. Various modifications exist without departing from the scope of the invention. For example, reference has already been made to different forms of construction of the release spring (for example, either a spring package or else a single spring) which increase or reduce the number of the structural parts which are needed in this region of the sole or heel holder.

A different modification consists of the development of a locking pawl constructed without a roller on the lower or upper leg. A sliding friction is created in this case which, however, is less than in other known sole or heel holders because sliding friction only exists between the upper side of the upper leg 5*b* and the lower side of the detent 26. A sloping plane which increases the friction force does not exist. The locking pawl 5 is supported by the combined forces from the spring package 11 and the locking part 9, the associated notch 13, the bight portion 5*e* of the locking pawl 5, the axis 4 of the locking pawl and by means of the lower leg of the locking pawl on the shoulder 1*b* of the sole down-holding member 1. In the case of an involuntary fall, the sole down-holding member 1 presses by means of its shoulder 1*b* on the free end region of the lower leg 5*a* of the locking pawl 5, wherein the locking pawl 5 is pivoted about the axle 4, so that it is sufficient if, in the end region of the elasticity range as shown in dash-dotted lines in FIG. 2, the roller 5*f* of the upper leg 5*b* rests on the underside of the detent 26.

Also, the setscrew 21 may have a different design. For example, the setscrew could be riveted at its upper end to the housing. The operating shoulder can also, as is shown in FIG. 4, be provided between the two legs of the forked support part, so that in this case the operating shoulder does not take up any space in a vertical direction. Furthermore, the head of the setscrew can be provided in a stepped, countersunk recess in the housing 12 to prevent unauthorized persons from manipulating the sole or heel holder after same has been adjusted by a mechanic. One can also proceed in such a manner that the head of the setscrew is enclosed in this region, but is made accessible by the skier in an emergency by breaking open the lock. Such a measure may, for example, be necessary in the case of a substantial change in the quality of the snow (such as icy or deep snow) or in the case of an important change in the slope (such as very steep slope). The mechanic, however, is no longer liable in this case for the correct adjustment of the sole or heel holder. After such a change a repeated adjustment of the same by the mechanic is needed so that the skier is assured of a correct adjustment.

The illustrated sole or heel holder will facilitate an arbitrary or voluntary opening of the binding with a ski pole, a ski shoe or by hand. Thus, it is to be assumed that this sole or heel holder is used in connection with ski brakes. If the inventive sole or heel holder is to be used in connection with a safety strap, then the hinge point of the release lever on the bearing block, in relationship to the jointed connection between the link member and the release lever, should be moved upwardly. Accordingly, the release lever is then designed differently, in that the axle 15 defining the fulcrum point of the release lever is moved above the point of engagement of the link member 18 and the release lever.

A further modification consists in the support part being pivotally adjustable about its axis to a position above the region of the upper side of the upper leg of the locking pawl so that the locking pawl is capable of being freely swung out about its axis with practically no counter force (except bearing friction). Thus, the sole down-holding member 1 is also able to be freely swingable upwardly. Through this measure, which is also inventively important, it is possible to adjust the sole or heel holder if needed for an easy opening by hand.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a sole holder having a sole downholding means which is pivotally supported on a base part and can be releasably held in a closed position for downhill skiing by a locking pawl which has a notch which can be engaged by a locking part, said locking part being biased by a spring and being a part of a first spring abutment which is supported for limited movement in a guideway of a support part, said support part being supported for pivotal movement about an axle which is supported on said base part, said spring being supported on said support part and operatively engaging said first spring abutment, and said locking pawl having one side which is cooperable with a detent provided on said base part and having on its other side said notch, the improvement comprising wherein said locking pawl is supported for pivotal movement about an axis and has a U-shape, including a bight and two legs of different length, one said leg extending into a recess provided in said base part and being supported on a shoulder provided on said sole down-holding means, and the other said leg being movable in the region of said detent as said locking pawl pivots about said axis, said detent being engaged by at least the free end region of said other leg of said locking pawl; wherein a row of said notches is provided on said bight of said U-shaped locking pawl, which bight extends substantially in a vertical direction and on which said spring-biased locking part is supported in a selected notch; and wherein said locking part is adjustable vertically by means of threaded cooperation with an upwardly projecting setscrew rotatably supported in said sole down-holding means to effect the selective support of said locking part in one of said notches.

2. The sole holder according to claim 1, wherein said support part for said locking part includes two spaced sidewalls; wherein between said sidewalls there is provided at least one said spring which is supported on a said first spring abutment and on a second spring abutment, said first spring abutment which is adjacent said locking pawl having said locking part thereon, which locking part is supportable selectively in said notches on said bight of said locking pawl, and said second spring abutment which is not adjacent said locking pawl being fixedly connected to at least one of said sidewalls of said support part.

3. The sole holder according to claim 2, wherein said setscrew by means of which the elevational position of said support part can be adjusted has threads which cooperate with a counterthread provided on an operating shoulder which is provided on said support part.

4. The sole holder according to claim 1 or claim 2, wherein said locking pawl is supported for pivotal movement by a further axle, said further axle being guided in an arcuate slot provided in said sole down-holding means which extends concentrically with respect to the pivot axis of said sole down-holding means.

5. The sole holder according to claim 1 or claim 2, wherein said locking pawl is operatively coupled by a link member to a release lever which is pivotally supported on said base part, said release lever having thereon a pin which is slidably disposed in a slot provided in said link member.

6. The sole holder according to claim 1 or claim 2, wherein said sole down-holding means is biased by a spring.

7. The sole holder according to claim 1, wherein said locking pawl has a roller rotatably supported on one of said legs thereof, and wherein said locking pawl is supported by said roller on a respective one of said shoulder of said sole down-holding means and said detent of said base part.

8. In a heel holder which includes a base part having a detent thereon, a housing supported on said base part for pivotal movement about a first axis between first and second positions and having sole hold-down means thereon, a locking pawl movably supported on said housing and engageable with said detent, and resilient means cooperable with said locking pawl for yieldably urging said locking pawl into engagement with said detent, the improvement comprising wherein said housing has a shoulder thereon, and wherein said locking pawl is generally U-shaped and has a bight and two legs, one said leg being engageable with said detent and the other said leg being engageable with said shoulder on said housing, said resilient means being cooperable with said bight of said locking pawl.

9. The heel holder according to claim 8, wherein said locking pawl includes a roller rotatably supported on one of said legs thereof and engageable with a respective one of said detent and said shoulder; and including spaced, aligned arcuate slots provided in said housing substantially concentric with said first axis and an axle slidably supported in said arcuate slots, said locking pawl being pivotally supported on said axle.

10. The heel holder according to claim 9, wherein said resilient means includes a spring support supported for rotation relative to said base part and relative to said housing about said first axis, a locking part movably supported on said spring support at a location spaced from said first axis and engageable with said bight of said locking pawl, a spring supported on said spring support and cooperable with said locking part for urging said locking part into engagement with said bight of said locking pawl, said locking part moving along said locking pawl bight in response to pivotal movement of said spring support relative to said housing, and including means cooperable with said spring support and housing for selectively varying the position of said spring support relative to said housing and for retaining said spring support in a selected angular position relative to said housing.

11. The heel holder according to claim 10, including a release lever pivotally supported on said housing and having a pin thereon, and an elongate link member pivotally supported at one end on said locking pawl at a location remote from said axle and having therein a slot adjacent the other end thereof, said pin on said release lever being slidably received in said slot in said link member.

* * * * *